US009252547B2

(12) United States Patent
Sun et al.

(10) Patent No.: US 9,252,547 B2
(45) Date of Patent: Feb. 2, 2016

(54) UNIVERSAL SERIAL BUS CONNECTOR

(71) Applicant: Cheng Uei Precision Industry Co., Ltd., New Taipei (TW)

(72) Inventors: Dao Rui Sun, Dong-Guan (CN); Gao Hua Du, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 75 days.

(21) Appl. No.: 14/324,125

(22) Filed: Jul. 4, 2014

(65) Prior Publication Data

US 2016/0006197 A1 Jan. 7, 2016

(51) Int. Cl.

| | |
|---|---|
| ***H01R 24/62*** | (2011.01) |
| ***H01R 13/6581*** | (2011.01) |
| ***H01R 13/502*** | (2006.01) |
| *H01R 13/516* | (2006.01) |
| *H01R 13/6591* | (2011.01) |
| *H01R 107/00* | (2006.01) |

(52) U.S. Cl.

CPC ..... *H01R 24/62* (2013.01); *H01R 13/502* (2013.01); *H01R 13/6581* (2013.01); *H01R 2107/00* (2013.01)

(58) Field of Classification Search

CPC .... H01R 13/6581; H01R 24/62; H01R 31/06; H01R 13/22; H01R 13/516; H01R 13/6591

USPC ..... 439/660, 607.55

See application file for complete search history.

(56) References Cited

U.S. PATENT DOCUMENTS

| | | | | |
|---|---|---|---|---|
| 2013/0337685 | A1* | 12/2013 | Hsu | H01R 13/658 439/607.01 |
| 2014/0024263 | A1* | 1/2014 | Dong | H01R 13/516 439/660 |
| 2014/0073190 | A1* | 3/2014 | Zhao | H01R 13/6594 439/626 |
| 2015/0044893 | A1* | 2/2015 | Chen | H01R 29/00 439/217 |
| 2015/0214669 | A1* | 7/2015 | Chen | H01R 31/06 439/607.24 |
| 2015/0214684 | A1* | 7/2015 | Chen | H01R 35/04 439/217 |
| 2015/0229075 | A1* | 8/2015 | Lin | H01R 13/635 439/153 |

* cited by examiner

*Primary Examiner* — James Harvey
*Assistant Examiner* — Matthew T Dzierzynski
(74) *Attorney, Agent, or Firm* — Cheng-Ju Chiang

(57) ABSTRACT

A universal serial bus connector includes an insulating housing, a tongue board assembly disposed to a front of the insulating housing, a plurality of first and second conductive terminals, and a shielding shell. Each of the first conductive terminals has a base strip, a fastening strip, a contact portion and a soldering strip. The fastening strips are integrally molded to the tongue board assembly with contact portions thereof projecting under a bottom of the tongue board assembly. Each of the second conductive terminals has a touching portion and a soldering slice. Each of the soldering slices is soldered to a top surface of a portion of one of the first conductive terminals facing to a bottom surface of the soldering slice. The second conductive terminals are integrally molded to the tongue board assembly with the touching portions thereof projecting beyond a top of the tongue board assembly.

20 Claims, 9 Drawing Sheets

UNIVERSAL SERIAL BUS CONNECTOR

BACKGROUND OF THE INVENTION

1. Field of the Invention

The present invention generally relates to a connector, and more particularly to a universal serial bus connector.

2. The Related Art

In order to unify connectors of different equipments for improving universalities of the connectors, universal serial bus (USB) connectors are the most common-used connector interfaces of current computers. The universal serial bus connectors support plug-and-play external buses. The universal serial bus connectors can be used for many kinds of peripheral devices, such as loudspeakers, telephones, joysticks, printers, scanners, cameras. With the popularity of the universal serial bus connectors, the universal serial bus connectors have been widely used in charging and data transmission fields at present.

Referring to FIG. 9, a current universal serial bus connector 100' adapted for being interconnected with a docking connector, includes an insulating housing 10', a base body 11', a plurality of conductive terminals 20' and a rectangular hollow-shaped shielding shell 30'. The conductive terminals 20' are integrally molded to the base body 11' with front ends thereof projecting beyond a top surface of the base body 11' and rear ends thereof being exposed outside from a rear end of the base body 11'. The shielding shell 30' surrounds the base body 11' together with the conductive terminals 20' to form an insertion space 40' between the shielding shell 30' and the base body 11'. The insulating housing 10' is molded to a rear end of the shielding shell 30'. The docking connector includes a docking tongue board, and a plurality of docking terminals disposed to the docking tongue board. When the current universal serial bus connector 100' is inserted into the docking connector, the docking tongue board together with the docking terminals is received in the insertion space 40'.

However, an obverse surface and a reverse surface of the current universal serial bus connector 100' need be distinguished to make the current universal serial bus connector 100' able to be inserted into the docking connector, if the current universal serial bus connector 100' is inserted into the docking connector reversely, the current universal serial bus connector 100' has no way of being inserted into the docking connector that causes the current universal serial bus connector 100' to be inserted into the docking connector in just one direction for making the current universal serial bus connector 100' unable to realize a fool-proof function. Furthermore, if the current universal serial bus connector 100' is hard inserted into the docking connector reversely that will generate damage of the docking tongue board and the docking terminals of the docking connector.

So it's essential for providing an innovative universal serial bus connector which is able to be inserted into the docking connector matched with the innovative universal serial bus connector in dual directions for facilitating users' usage.

SUMMARY OF THE INVENTION

An object of the present invention is to provide a universal serial bus connector. The universal serial bus connector includes an insulating housing, a tongue board assembly, a plurality of first conductive terminals, a plurality of second conductive terminals and a shielding shell. A front of the insulating housing defines a guiding groove. The tongue board assembly is disposed to and spaced a distance from a front of the insulating housing. Each of the first conductive terminals has a base strip, a fastening strip connected with a front end of the base strip, a contact portion punched outward from the fastening strip, and a soldering strip connected with a rear end of the base strip. The fastening strips are integrally molded to the tongue board assembly in sequence with contact portions thereof projecting under a bottom of the tongue board assembly. The soldering strips are integrally molded to the insulating housing and are exposed under a bottom of the insulating housing with bottom surfaces thereof being aligned. Top surfaces of middles of the base strips are aligned and the middles of the base strips are received in the guiding groove. Each of the second conductive terminals has a touching portion located at an outer surface of a front end thereof, and a soldering slice located at a tail end thereof. Each of the soldering slices is soldered to a top surface of a portion of one of the first conductive terminals facing to a bottom surface of the soldering slice to realize an electrical connection between the second conductive terminal and the first conductive terminal. The second conductive terminals are integrally molded to the tongue board assembly with the touching portions thereof projecting beyond a top of the tongue board assembly. The touching portion of each second conductive terminal is symmetrical to the contact portion of the corresponding first conductive terminal with respect to the tongue board assembly. A rear of the shielding shell surrounds the insulating housing together with rear ends of the first conductive terminals and the second conductive terminals, and a front of the shielding shell surrounds the insulating housing and the tongue board assembly together with the front ends of the first conductive terminals and the second conductive terminals to form an insertion space among the front of the shielding shell, the insulating housing and the tongue board assembly.

As described above, when the universal serial bus connector is inserted into a docking connector normally, the contact portions of the first conductive terminals are electrically connected with docking terminals of the docking connector, when the universal serial bus connector is inserted into the docking connector reversely, the touching portions of the second conductive terminals are electrically connected with the docking terminals by virtue of each of the soldering slices of the second conductive terminals being soldered to the top surface of the portion of one of the first conductive terminals facing to the bottom surface of the soldering slice. So that the universal serial bus connector is able to be inserted into the docking connector in the dual directions to realize fool-proof function for facilitating users' usage. Furthermore, even the current universal serial bus connector is hard inserted into the docking connector reversely, it will effectively prevent generating damage of the docking tongue board and the docking terminals of the docking connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
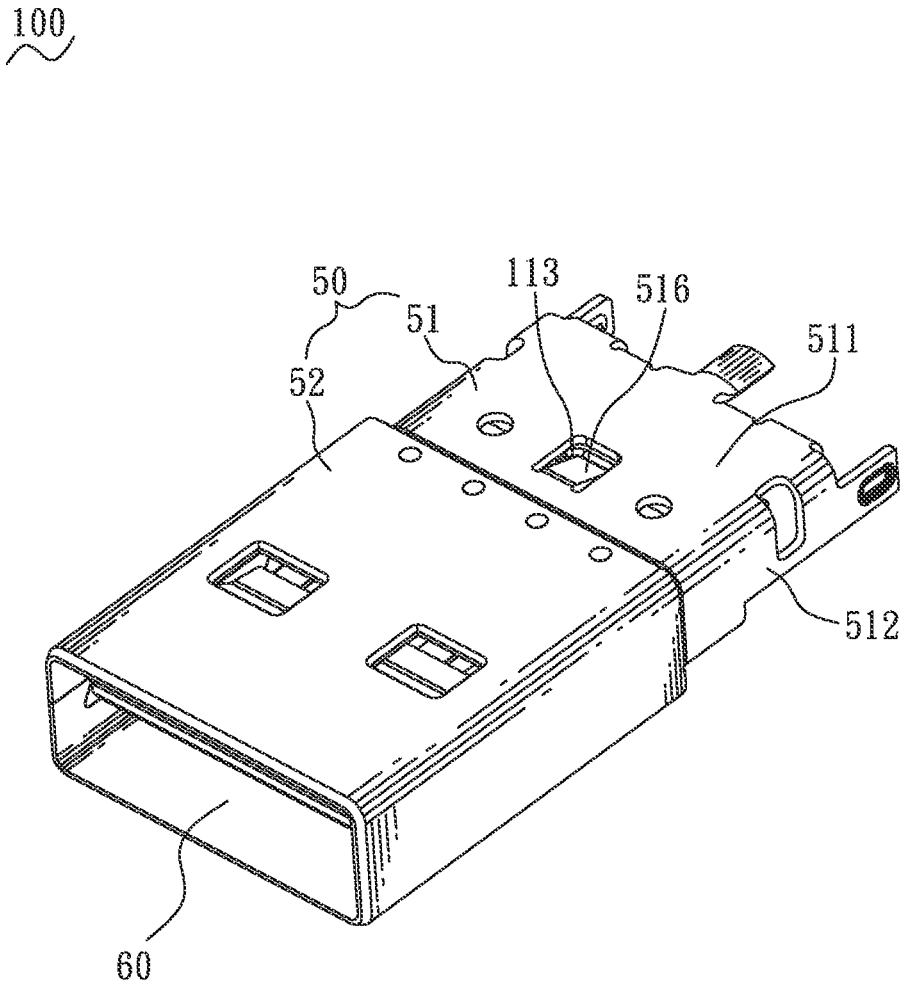
FIG. 1 is a perspective view of a universal serial bus connector in accordance with an embodiment of the present invention.

With reference to FIG. 1, FIG. 3, FIG. 5 and FIG. 7, a universal serial bus connector 100 in accordance with an embodiment of the present invention is shown. The universal serial bus connector 100 adapted for being interconnected with a docking connector 200, includes an insulating housing 10, a tongue board assembly 20, a plurality of first conductive terminals 30, a plurality of second conductive terminals 40 and a shielding shell 50. The docking connector 200 matched with the universal serial bus connector 100, includes a docking tongue board 201, and a plurality of docking terminals 202 disposed to the docking tongue board 201.

Figure 2:
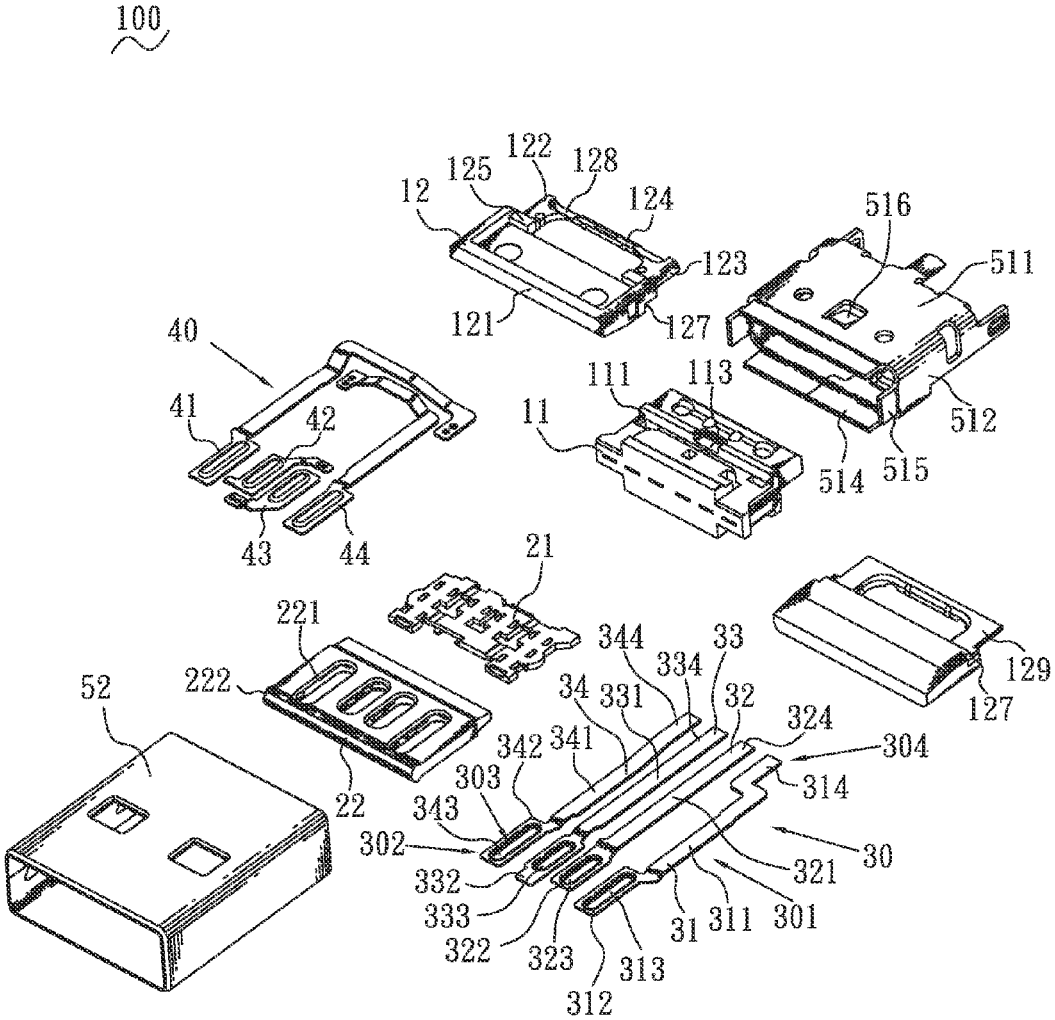
FIG. 2 is an exploded view of the universal serial bus connector of FIG. 1.
Figure 3:
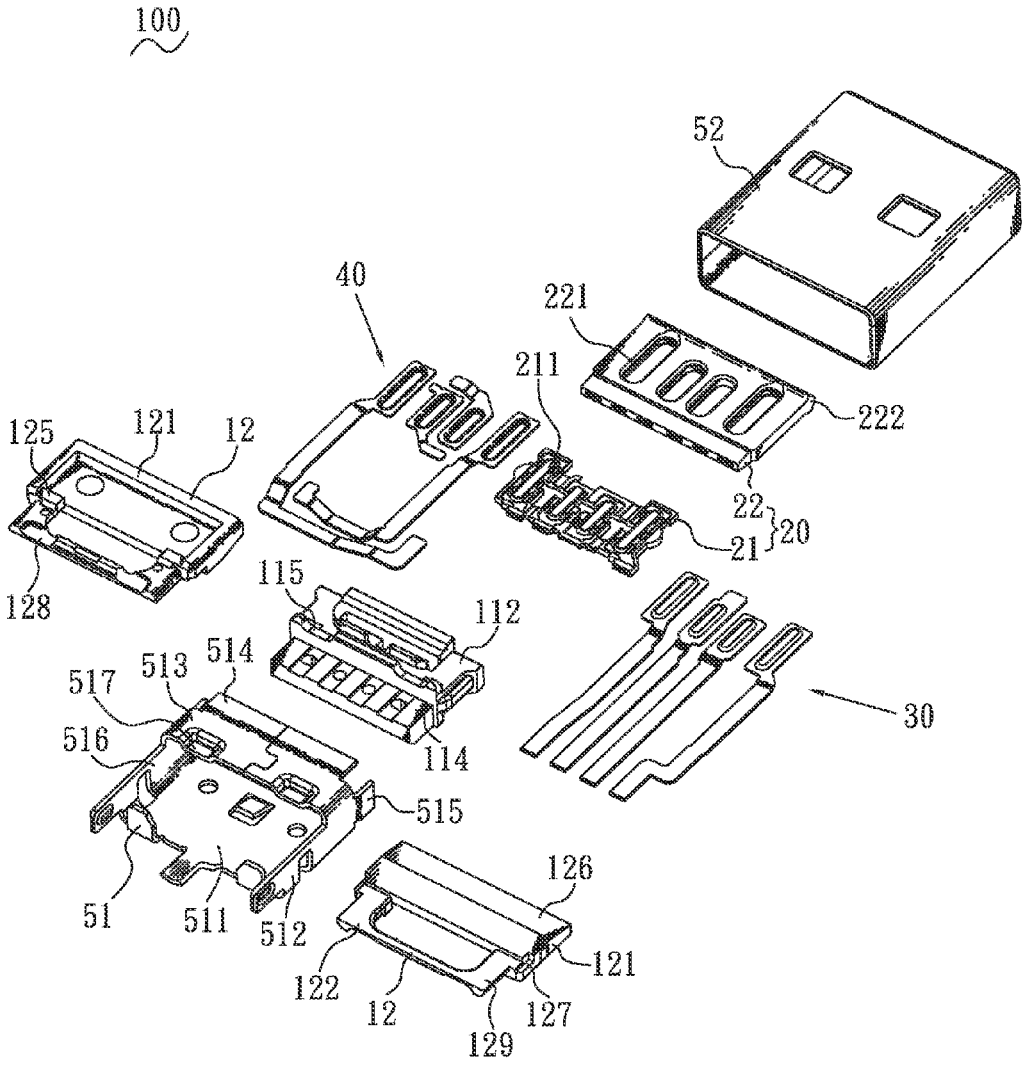
FIG. 3 is another exploded view of the universal serial bus connector of FIG. 1.

Referring to FIG. 2 and FIG. 3, the insulating housing 10 includes a rectangular first base body 11, and two second base bodies 12 respectively disposed to a top and a bottom of the first base body 11. A front end of the first base body 11 defines a U-shaped first locating groove 111 penetrating through a top surface, two tops of two opposite side surfaces and two tops of two opposite sides of a front surface thereof, and a U-shaped second locating groove 112 penetrating through a bottom surface, two bottoms of the two opposite side surfaces and two bottoms of the two opposite sides of the front surface thereof. A middle of a top surface of a rear end of the first base body 11 is recessed downward to form a notch 113 communicating with the first locating groove 111. A rear of a bottom surface of the rear end of the first base body 11 is recessed inward to form a first lacking groove 114. Two opposite sides of a front of the bottom surface of the rear end of the first base body 11 are recessed inward to form two first recesses 115.

Referring to FIG. 2 and FIG. 3, each second base body 12 has a rectangular base portion 121, and a U-shaped locating portion 122 connected with a rear surface of the base portion 121. The locating portion 122 includes two extending portions 123 extended rearward from two opposite sides of the rear surface of the base portion 121, and an elongated connecting portion 124 connected between two distal ends of the two extending portions 123. The base portion 121 defines a first buckling groove 125 penetrating through a rear of an outer surface and a rear surface thereof. A front of an inner surface of the base portion 121 is inclined forward and inward to form a guiding surface 126. The base portion 121 defines two second buckling grooves 127 respectively penetrating through two opposite side surfaces, two opposite sides of the inner surface, and two opposite sides of the rear surface thereof. Two opposite sides of an outer surface of the connecting portion 124 are recessed inward to form two second recesses 128. A rear of the inner surface of the base portion 121 is recessed inward to form a second lacking groove 129 penetrating through a rear surface of the connecting portion 124.

Figure 5:
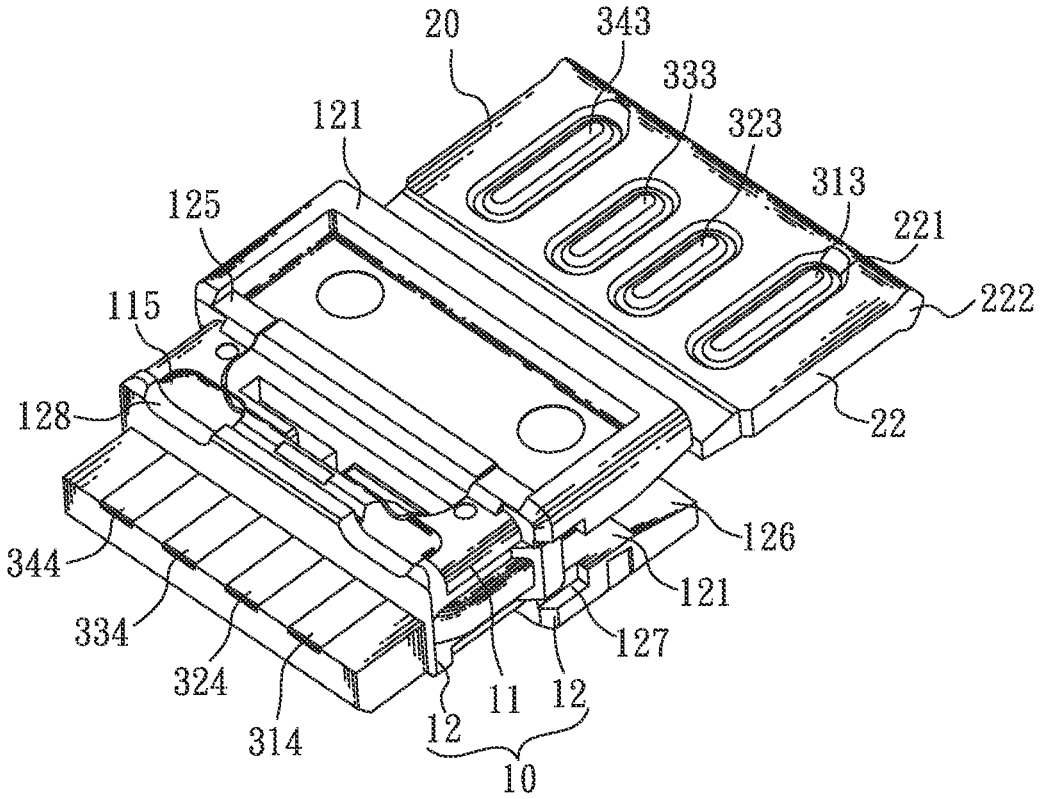
FIG. 5 is a perspective view of the universal serial bus connector of FIG. 1, wherein a shielding shell is moved away.
Figure 6:
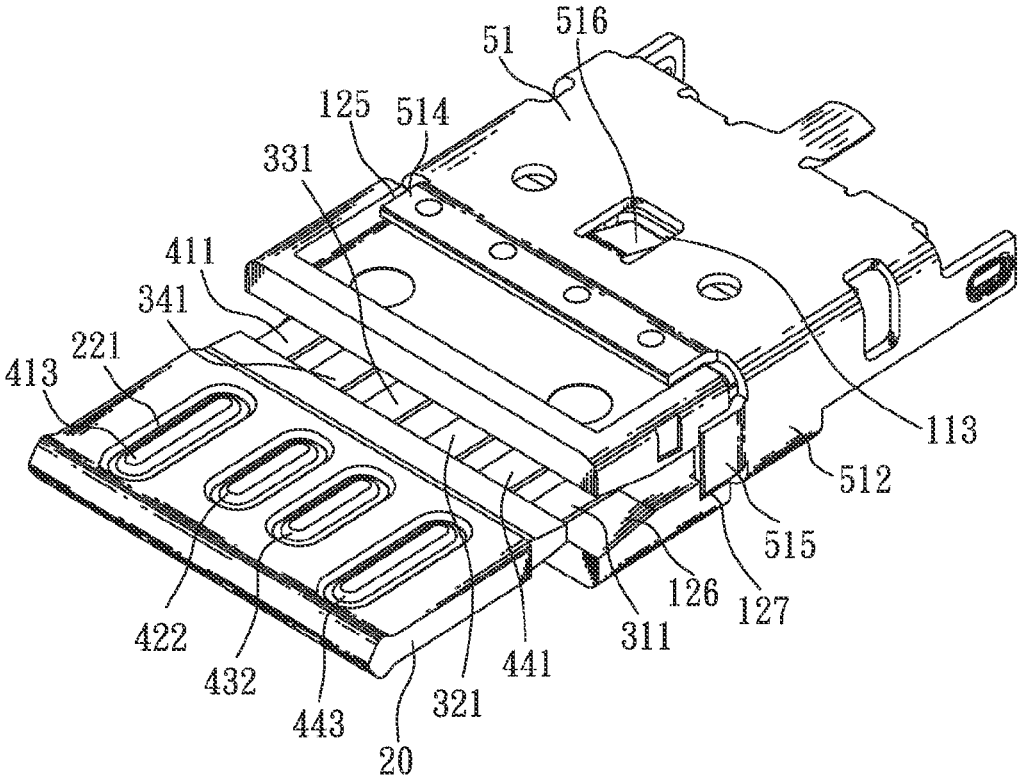
FIG. 6 is a perspective view of the universal serial bus connector of FIG. 1, wherein a second shell is moved away.
Figure 7:
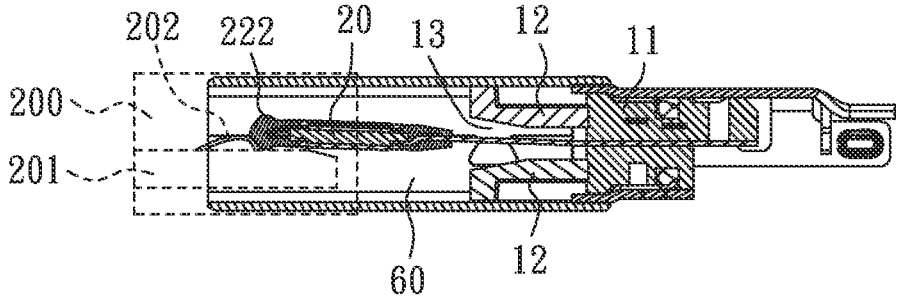
FIG. 7 is a perspective view of the universal serial bus connector of FIG. 1, wherein the universal serial bus connector is started to be inserted into a docking connector.
Figure 8:
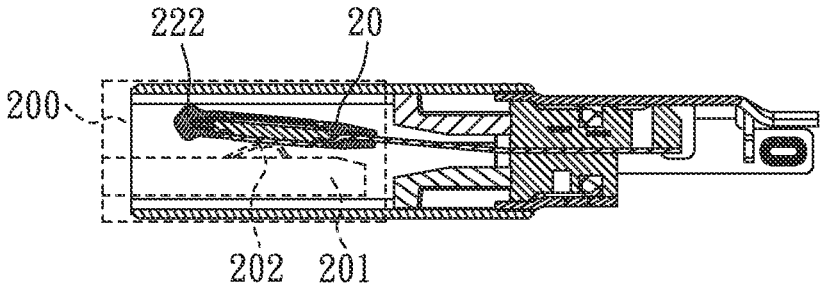
FIG. 8 is a perspective view of the universal serial bus connector of FIG. 1, wherein the universal serial bus connector is completed being inserted into the docking connector.
Figure 9:
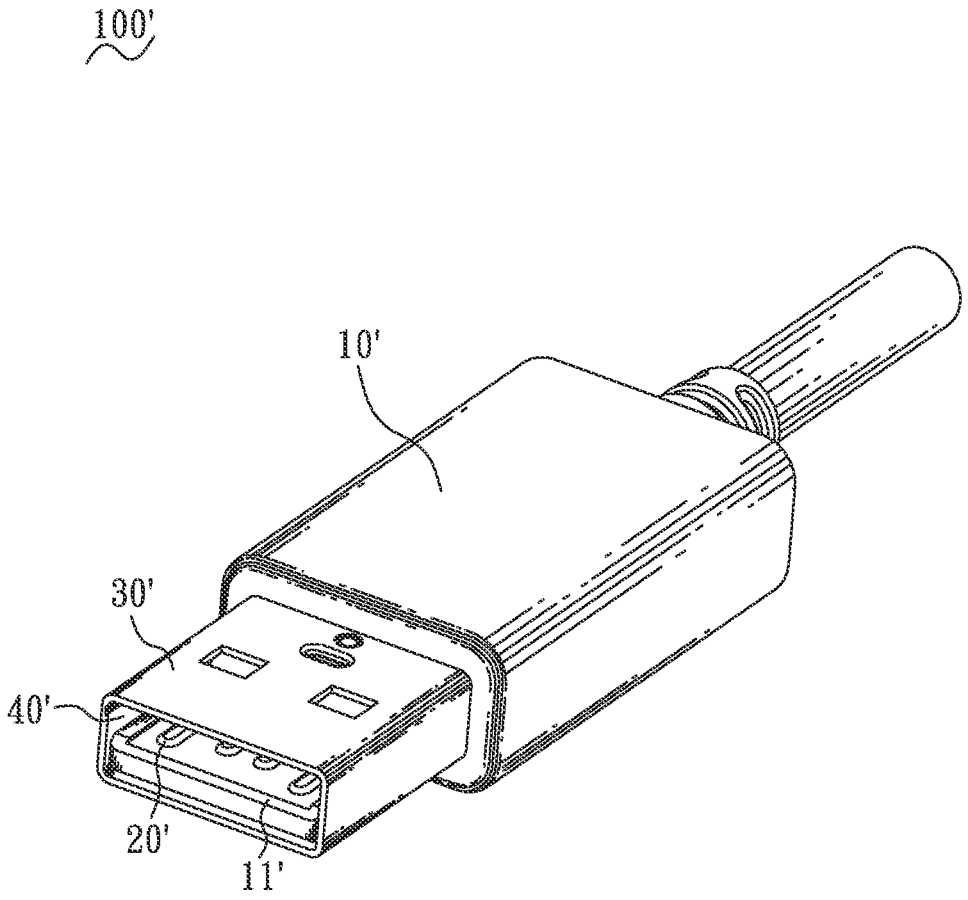
FIG. 9 (Prior Art)
FIG. 9 is a perspective view of a current universal serial bus connector in prior art.

Referring to FIG. 2, FIG. 3 and FIG. 5, the tongue board assembly 20 is disposed to and spaced a distance from a middle of a front of the insulating housing 10. The tongue board assembly 20 includes a rectangular first tongue board 21 and a rectangular second tongue board 22. The first tongue board 21 defines a plurality of the first openings 211 vertically penetrating therethrough and transversely arranged at regular intervals. The second tongue board 22 defines a plurality of the second openings 221 vertically penetrating therethrough and transversely arranged at regular intervals. The second openings 221 are corresponding to the first openings 211. A front of the second tongue board 22 protrudes outward to form a mushroom-head guiding portion 222 projecting beyond a top surface and a bottom surface of the second tongue board 22.

Referring to FIG. 2, each of the first conductive terminals 30 has a base strip 301, a fastening strip 302 connected with a front end of the base strip 301, a contact portion 303 punched outward from the fastening strip 302, and a soldering strip 304 connected with a rear end of the base strip 301. Specifically, the first conductive terminals 30 include a first ground terminal 31, a first signal terminal 32, a second signal terminal 33 and a first power terminal 34 which are transversely arranged in sequence and integrally molded to the first tongue board 21. The first signal terminal 32 and the second signal terminal 33 are spaced from each other and are located between the first ground terminal 31 and the first power terminal 34.

The first ground terminal 31 has an elongated first base strip 311, a first fastening strip 312 bent downward, then slantwise extended forward and towards the first signal terminal 32, and further extended forward from a front end of the first base strip 311, a first contact portion 313 punched outward from a top surface of the first fastening strip 312 and projecting under a bottom surface of the first fastening strip 312, and a first soldering strip 314 extended towards the first signal terminal 32 and then extended rearward from a rear end of the first base strip 311.

Referring to FIG. 2, the first signal terminal 32 has a second base strip 321, a second fastening strip 322 bent downward, and then extended forward from a front end of the second base strip 321, a second contact portion 323 punched outward from a top surface of the second fastening strip 322 and projecting under a bottom surface of the second fastening strip 322, and a second soldering strip 324 extended rearward from a rear end of the second base strip 321.

Referring to FIG. 2, the second signal terminal 33 has a third base strip 331, a third fastening strip 332 bent downward, and then extended forward from a front end of the third base strip 331, a third contact portion 333 punched outward from a top surface of the third fastening strip 332 and projecting under a bottom surface of the third fastening strip 332, and a third soldering strip 334 extended rearward from a rear end of the third base strip 331.

Referring to FIG. 2, the first power terminal 34 has a fourth base strip 341, a fourth fastening strip 342 bent downward, and then extended forward from a front end of the fourth base strip 341, and a fourth contact portion 343 punched downward from a top surface of the fourth fastening strip 342 and projecting under a bottom surface of the fourth contact portion 343, a fourth soldering strip 344 extended rearward from a rear end of the fourth base strip 341.

The first base strip 311, the second base strip 321, the third base strip 331 and the fourth base strip 341 are designated as the base strips 301. The first fastening strip 312, the second fastening strip 322, the third fastening strip 332 and the fourth fastening strip 342 are designated as the fastening strips 302.

The first contact portion 313, the second contact portion 323, the third contact portion 333 and the fourth contact portion 343 are designated as the contact portions 303. The first soldering strip 314, the second soldering strip 324, the third soldering strip 334 and the fourth soldering strip 344 are designated as the soldering strips 304.

Figure 4:
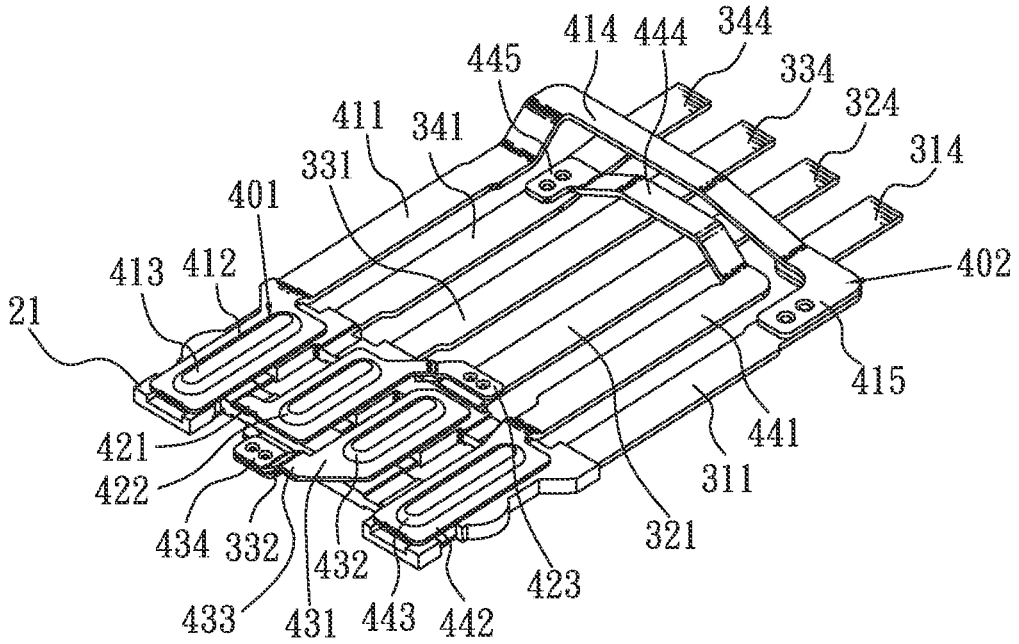
FIG. 4 is a perspective view of the universal serial bus connector of FIG. 1, wherein first and second conductive terminals of the universal serial bus connector are soldered with each other.

Referring to FIG. 2 and FIG. 4, each of the second conductive terminals 40 has a touching portion 401 located at an outer surface of a front end thereof, and a soldering slice 402 located at a tail end thereof. Specifically, the second conductive terminals 40 partially disposed above and soldered to the first conductive terminals 30, include a second ground terminal 41, a third signal terminal 42, a fourth signal terminal 43 and a second power terminal 44 which are transversely arranged in sequence and integrally molded to the second tongue board 22. The third signal terminal 42 and the fourth signal terminal 43 are spaced from each other and located between the second ground terminal 41 and the second power terminal 44.

The second ground terminal 41 has an elongated first base slice 411, a first fastening slice 412 slantwise extended upward and forward, then extended forward and towards the third signal terminal 42 and further extended forward from a front end of the first base slice 411, and a first touching portion 413 punched upward from a bottom surface of the first base slice 411 and projecting beyond a top surface of the first fastening slice 412, a first connecting slice 414 slantwise extended upward and rearward, then extended rearward, next bent perpendicular to the first base slice 411, and further slantwise extended downward from a rear end of the first base slice 411, a first soldering slice 415 extended transversely, and then bent forward from a free end of the first connecting slice 414. The first soldering slice 415 is located above a top surface of a rear end of the first base strip 311, and the top surface of the rear end of the first base strip 311 faces to a bottom surface of the first soldering slice 415.

Referring to FIG. 2 and FIG. 4, the third signal terminal 42 has a rectangular second fastening slice 421, a second touching portion 422 punched upward from a bottom surface of the second fastening slice 421 and projecting beyond a top surface of the second fastening slice 421, and a second soldering slice 423 slantwise extended rearward and towards the fourth signal terminal 43, and then extended transversely and away from the second fastening slice 421 from one side of a rear end of the second fastening slice 421. The second soldering slice 423 is located above a top surface of a front end of the second base strip 321, and the top surface of the front end of the second base strip 321 faces to a bottom surface of the second soldering slice 423.

Referring to FIG. 2 and FIG. 4, the fourth signal terminal 43 has a rectangular third fastening slice 431, a third touching portion 432 punched upward from a bottom surface of the third fastening slice 431 and projecting beyond a top surface of the third fastening slice 431, a second connecting slice 433 extended transversely and away from the second power terminal 44, and then slantwise extended downward from a front end of the third fastening slice 431, and a third soldering slice 434 extended transversely and away from the third fastening slice 431 from a free end of the second connecting slice 433. The third soldering slice 434 is located above a top surface of a front end of the third fastening strip 332, and the top surface of the front end of the third fastening strip 332 faces to a bottom surface of the third soldering slice 434.

Referring to FIG. 2 and FIG. 4, the second power terminal 44 has an elongated second base slice 441 disposed to an inner side of the first soldering slice 415, a fourth fastening slice 442 slantwise extended upward and forward, then extended forward and away from the fourth signal terminal 43 and further extended forward from a front end of the second base slice 441, a fourth touching portion 443 punched upward from a bottom surface of the fourth fastening slice 442 and projecting beyond a top surface of the fourth fastening slice 442, a third connecting slice 444 slantwise extended upward and away from the first soldering slice 415, then extended transversely and towards the second ground terminal 41, and further slantwise extended downward and away from the second base slice 441 from one side of a rear end of the second base slice 441 adjacent to the fourth signal terminal 43, and a fourth soldering slice 445 extended transversely and towards the second ground terminal 41, and then extended forward from a free end of the third connecting slice 444. The third connecting slice 444 and the fourth soldering slice 445 are located in front of the first connecting slice 414. The fourth soldering slice 445 is located above a top surface of a rear end of the fourth base strip 341, and the top surface of the rear end of the fourth base strip 341 faces to a bottom surface of the fourth soldering slice 445.

The first touching portion 413, the second touching portion 422, the third touching portion 432 and the fourth touching portion 443 are designated as the touching portions 401. The first soldering slice 415, the second soldering slice 423, the third soldering slice 434 and the fourth soldering slice 445 are designated as the soldering slices 402.

Referring to FIG. 1 to FIG. 3, the shielding shell 50 includes a first shell 51 and a rectangular hollow-shaped second shell 52. The first shell 51 has a rectangular top plate 511, two lateral plates 512 extended downward from two opposite sides of the top plate 511, and a bottom plate 513 connected between two fronts of two bottom edges of the two lateral plates 512. Front edges of the top plate 511 and the bottom plate 513 are spread outward, and then extend forward to form two first buckling plates 514. Two front edges of the two lateral plates 512 are arched outward and then extend forward to form two second buckling plates 515. A front of a middle of the top plate 511 is punched downward to form an elastic piece 516. Two opposite sides of the bottom plate 513 are punched inward to form two convex portions 517.

Referring to FIG. 1 to FIG. 7, the first conductive terminals 30 are integrally molded to the tongue board assembly 20 in sequence. The fastening strips 302 are integrally molded to the tongue board assembly 20 in sequence with the contact portions 303 thereof projecting under a bottom of the tongue board assembly 20. Each of the soldering slices 402 of the second conductive terminals 40 is soldered to a top surface of a portion of one of the first conductive terminals 30 facing to a bottom surface of the soldering slice 402 to realize an electrical connection between the second conductive terminal 40 and the first conductive terminal 30. The second conductive terminals 40 are partially disposed above the first conductive terminals 30 and are integrally molded to the tongue board assembly 20 with the touching portions 401 thereof projecting beyond a top of the tongue board assembly 20. The touching portion 401 of each second conductive terminal 40 is symmetrical to the contact portion 303 of the corresponding first conductive terminal 30 with respect to the tongue board assembly 20.

Specifically, at first, the first fastening strip 312 of the first ground terminal 31, the second fastening strip 322 of the first signal terminal 32, the third fastening strip 332 of the second signal terminal 33 and the fourth fastening strip 342 of the first power terminal 34 are integrally molded to the first tongue board 21 in sequence with the first contact portion 313, the second contact portion 323, the third contact portion 333 and the fourth contact portion 343 projecting under a bottom surface of the first tongue board 21 through the first openings 211. Then the first fastening slice 412 of the second ground terminal 41, the second fastening slice 421 of the third signal terminal 42, the third fastening slice 431 of the fourth signal terminal 43 and the fourth fastening slice 442 of the second power terminal 44 are transversely disposed on a top surface of the first tongue board 21 in sequence. So, the first fastening slice 412 is located over the fourth fastening strip 342. The second fastening slice 421 is located over the third fastening strip 332. The third fastening slice 431 is located over the second fastening strip 322. The fourth fastening slice 442 is located over the first fastening strip 312.

Then, the bottom surface of the first soldering slice 415 of the second ground terminal 41 is soldered to the top surface of the rear end of the first base strip 311 of the first ground terminal 31 to realize an electrical connection between the second ground terminal 41 and the first ground terminal 31. The bottom surface of the second soldering slice 423 of the third signal terminal 42 is soldered to the top surface of the front end of the second base strip 321 of the first signal terminal 32 to realize an electrical connection between the third signal terminal 42 and the first signal terminal 32. The bottom surface of the third soldering slice 434 of the fourth signal terminal 43 is soldered to the top surface of the front end of the third fastening strip 332 of the second signal terminal 33 to realize an electrical connection between the fourth signal terminal 43 and the second signal terminal 33. The bottom surface of the fourth soldering slice 445 of the second power terminal 44 is soldered to the top surface of the rear end of the fourth base strip 341 of the first power terminal 34 to realize an electrical connection between the second power terminal 44 and the first power terminal 34.

The first touching portion 413, the second touching portion 422, the third touching portion 432 and the fourth touching portion 443 are transversely located above the top surface of the first tongue board 21 in sequence. The first touching portion 413 is symmetrical to the fourth contact portion 343 with respect to the first tongue board 21 of the tongue board assembly 20. The second touching portion 422 is symmetrical to the third contact portion 333 with respect to the first tongue board 21 of the tongue board assembly 20. The third touching portion 432 is symmetrical to the second contact portion 323 with respect to the first tongue board 21 of the tongue board assembly 20. The fourth touching portion 443 is symmetrical to the first contact portion 313 with respect to the first tongue board 21 of the tongue board assembly 20.

At last, the second tongue board 22 is integrally molded to an outside of the first tongue board 21, front ends of the first conductive terminals 30 and outer peripheries of the front ends of the second conductive terminals 40. Specifically, the front end of the first base strip 311 with the first fastening strip 312, the front end of the second base strip 321 with the second fastening strip 322, the front end of the third base strip 331 with the third fastening strip 332, and the front end of the fourth base strip 341 with the fourth fastening strip 342 are transversely and integrally molded in the second tongue board 22 of the tongue board assembly 20 in sequence. The first tongue board 21 is molded in the second tongue board 22. The front end of the first base slice 411 with the first fastening slice 412, the second fastening slice 421 with the second soldering slice 423, the third fastening slice 431 with the second connecting slice 433 and the third soldering slice 434, the front end of the second base slice 441 with the fourth fastening slice 442 are transversely and integrally molded in the second tongue board 22 of the tongue board assembly 20. The first contact portion 313, the second contact portion 323, the third contact portion 333 and the fourth contact portion 343 project under the bottom surface of the second tongue board 22 of the tongue board assembly 20 through the second openings 221. The first touching portion 413, the second touching portion 422, the third touching portion 432 and the fourth touching portion 443 project beyond the top surface of the second tongue board 22 of the tongue board assembly 20 through the second openings 221.

The soldering strips 304 of the first conductive terminals 30 are integrally molded to the insulating housing 10 and are exposed under a bottom of the insulating housing 10 with bottom surfaces thereof being aligned. The soldering strips 304 of the first conductive terminals 30 are flush with a top sidewall of the first lacking groove 114. Bottom surfaces of the soldering strips 304 are soldered with a cable (not shown). Specifically, the rear end of the first base strip 311 with the first soldering strip 314, the rear end of the second base strip 321 with the second soldering strip 324, the rear end of the third base strip 331 with the third soldering strip 334, the rear end of the fourth base strip 341 with the fourth soldering strip 344, the rear end of the first base slice 411, the first connecting slice 414, the first soldering slice 415, the rear end of the second base slice 441, the third connecting slice 444 and the fourth soldering slice 445 are integrally molded to the first base body 11 of the insulating housing 10. The first soldering strip 314, the second soldering strip 324, the third soldering strip 334 and the fourth soldering strip 344 are exposed in the first lacking groove 114. Bottom surfaces of the first soldering strip 314, the second soldering strip 324, the third soldering strip 334 and the fourth soldering strip 344 are aligned and are flush with the top sidewall of the first lacking groove 114. The bottom surfaces of the first soldering strip 314, the second soldering strip 324, the third soldering strip 334 and the fourth soldering strip 344 are soldered with the cable.

The second base bodies 12 are oppositely disposed to a top and a bottom of the first base body 11 of the insulating housing 10. The locating portions 122 of the second base bodies 12 are respectively located in the first locating groove 111 and the second locating groove 112. An upper portion and a lower portion of the front surface of the front end of the first base body 11 respectively abut against front sidewalls of the second lacking groove 129. The two guiding surfaces 126 of the two second base bodies 12 are disposed oppositely. A front of the insulating housing 10 defines a guiding groove 13. Specifically, front ends of the base portions 121 of the second base bodies 12 are spaced from each other and project beyond the front surface of the front end of the first base body 11 to form a guiding groove 13 thereamong. The guiding groove 13 gradually becomes narrower from front to rear to make a rear thereof narrower than a front thereof. The two first recesses 115 are corresponding to and communicate with the two second recesses 128, respectively. Middle of the first base slice 411 and the second base slice 441, and middles of the first base strip 311, the second base strip 321, the third base strip 331 and the fourth base strip 341 are transversely arranged. Top surfaces of middles of the base strips 301 are aligned and the middles of the base strips 301 are received in the guiding groove 13. Top surfaces of the middles of the first base slice 411, the second base slice 441, the first base strip 311, the second base strip 321, the third base strip 331 and the fourth base strip 341 are aligned, and the middles of the first base slice 411, the second base slice 441, the first base strip 311, the second base strip 321, the third base strip 331 and the fourth base strip 341 are received in the guiding groove 13.

A rear of the shielding shell 50 surrounds the insulating housing 10 together with the rear ends of the first conductive terminals 30 and the second conductive terminals 40, and a front of the shielding shell 50 surrounds the insulating housing 10 and the tongue board assembly 20 together with the front ends of the first conductive terminals 30 and the second conductive terminals 40 to form an insertion space 60 among the front of the shielding shell 50, the insulating housing 10 and the tongue board assembly 20. The first shell 51 surrounds the first base body 11. The first buckling plate 514 is buckled in the first buckling groove 125. The second buckling plate 515 is buckled in the second buckling groove 127 and resists against a front sidewall of the second buckling groove.

A rear end of the second shell 52 surrounds and is soldered with a front end of the first shell 51. The rear end of the second shell 52 surrounds outsides of the first buckling plates 514 and the second buckling plates 515. Insides of a top and a bottom of the rear end of the second shell 52 are soldered to the outsides of the first buckling plates 514. A front end of the second shell 52 surrounds the front ends of the base portions 121 of the second base bodies 12 and the tongue board assembly 20 together with the front ends of the first conductive terminals 30 and the second conductive terminals 40 to form the insertion space 60 among the front end of the second shell 52, the front ends of the base portions 121 of the second base bodies 12 and the tongue board assembly 20. Each of the convex portions 517 is received between the first recess 115 and the second recess 128. The elastic piece 516 is elastically received in the notch 113.

Referring to FIG. 1 to FIG. 8, when the universal serial bus connector 100 is inserted into the docking connector 200 normally, the tongue board assembly 20 is guided by the guiding portion 222 to be inserted forward along the docking tongue board 201 and the docking terminals 202, the docking tongue board 201 together with the docking terminals 202 is received in the insertion space 60. At the time of the universal serial bus connector 100 being inserted in place, the contact portions 303 of the first conductive terminals 30 are electrically connected with the docking terminals 202 of the docking connector 200 by virtue of the elastic functions of the first base slice 411, the second base slice 441, the first base strip 311, the second base strip 321, the third base strip 331 and the fourth base strip 341. When the universal serial bus connector 100 is inserted into the docking connector 200 reversely, the tongue board assembly 20 is guided by the guiding portion 222 to be inserted forward along the docking tongue board 201 and the docking terminals 202, the docking tongue board 201 together with the docking terminals 202 is received in the insertion space 60. At the time of the universal serial bus connector 100 being inserted in place, the touching portions 401 of the second conductive terminals 40 are electrically connected with the docking terminals 202 by virtue of each of the soldering slices 402 of the second conductive terminals 40 being soldered to the top surface of the portion of one of the first conductive terminals 30 facing to the bottom surface of the soldering slice 402, namely, the first touching portion 413 of the second ground terminal 41, the second touching portion 422 of the third signal terminal 42, the third touching portion 432 of the fourth signal terminal 43 and the fourth touching portion 443 of the second power terminal 44 being soldered to the first ground terminal 31, the first signal terminal 32, the second signal terminal 33 and the first power terminal 34. So that the universal serial bus connector 100 realizes the dual-direction inserting function to be used conveniently.

As described above, when the universal serial bus connector 100 is inserted into the docking connector 200 normally, the contact portions 303 of the first conductive terminals 30 are electrically connected with the docking terminals 202 of the docking connector 200, when the universal serial bus connector 100 is inserted into the docking connector 200 reversely, the touching portions 401 of the second conductive terminals 40 are electrically connected with the docking terminals 202 by virtue of each of the soldering slices 402 of the second conductive terminals 40 being soldered to the top surface of the portion of one of the first conductive terminals 30 facing to the bottom surface of the soldering slice 402. So that the universal serial bus connector 100 is able to be inserted into the docking connector 200 in the dual directions to realize fool-proof function for facilitating users' usage. Furthermore, even the current universal serial bus connector 100 is hard inserted into the docking connector 200 reversely, it will effectively prevent generating damage of the docking tongue board 201 and the docking terminals 202 of the docking connector 200.

What is claimed is:

1. A universal serial bus connector, comprising:

an insulating housing, a front of the insulating housing defining a guiding groove;

a tongue board assembly disposed to and spaced a distance from a front of the insulating housing;

a plurality of first conductive terminals of which each has a base strip, a fastening strip connected with a front end of the base strip, a contact portion punched outward from the fastening strip, and a soldering strip connected with a rear end of the base strip, the fastening strips being integrally molded to the tongue board assembly in sequence with contact portions thereof projecting under a bottom of the tongue board assembly, the soldering strips integrally molded to the insulating housing and being exposed under a bottom of the insulating housing with bottom surfaces thereof being aligned, top surfaces of middles of the base strips being aligned and the middles of the base strips being received in the guiding groove;

a plurality of second conductive terminals of which each has a touching portion located at an outer surface of a front end thereof and a soldering slice located at a tail end thereof, each of the soldering slices being soldered to a top surface of a portion of one of the first conductive terminals facing to a bottom surface of the soldering slice to realize an electrical connection between the second conductive terminal and the first conductive terminal, the second conductive terminals being integrally molded to the tongue board assembly with the touching portions thereof projecting beyond a top of the tongue board assembly, the touching portion of each second conductive terminal being symmetrical to the contact portion of the corresponding first conductive terminal with respect to the tongue board assembly; and a shielding shell, a rear of the shielding shell surrounding the insulating housing together with rear ends of the first conductive terminals and the second conductive terminals, and a front of the shielding shell surrounding the insulating housing and the tongue board assembly together with the front ends of the first conductive terminals and the second conductive terminals to form an insertion space among the front of the shielding shell, the insulating housing and the tongue board assembly.

2. The universal serial bus connector as claimed in claim 1, wherein the insulating housing includes a first base body, a rear of a bottom surface of a rear end of the first base body is recessed inward to form a first lacking groove, the soldering strips of the first conductive terminals are flush with a top sidewall of the first lacking groove.

3. The universal serial bus connector as claimed in claim 2, wherein the first conductive terminals include a first ground terminal, a first signal terminal, a second signal terminal and a first power terminal, the first ground terminal has a first base strip, and a first fastening strip bent downward, then slantwise extended forward and towards the first signal terminal, and further extended forward from a front end of the first base strip, the first signal terminal has a second base strip, and a second fastening strip bent downward, and then extended forward from a front end of the second base strip, the second signal terminal has a third base strip, and a third fastening strip bent downward, and then extended forward from a front end of the third base strip, the first power terminal has a fourth base strip, and a fourth fastening strip bent downward, and then extended forward from a front end of the fourth base strip, the front end of the first base strip with the first fastening strip, the front end of the second base strip with the second fastening strip, the front end of the third base strip with the third fastening strip, and the front end of the fourth base strip with the fourth fastening strip are transversely and integrally molded in the tongue board assembly.

4. The universal serial bus connector as claimed in claim 3, wherein the first ground terminal has a first contact portion punched outward from a top surface of the first fastening strip and projecting under a bottom surface of the first fastening strip, the first signal terminal has a second contact portion punched outward from a top surface of the second fastening strip and projecting under a bottom surface of the second fastening strip, the second signal terminal has a third contact portion punched outward from a top surface of the third fastening strip and projecting under a bottom surface of the third fastening strip, the first power terminal has a fourth contact portion punched downward from a top surface of the fourth fastening strip and projecting under a bottom surface of the fourth contact portion, the first contact portion, the second contact portion, the third contact portion and the fourth contact portion project under the bottom of the tongue board assembly.

5. The universal serial bus connector as claimed in claim 4, wherein the second conductive terminals include a second ground terminal, a third signal terminal, a fourth signal terminal and a second power terminal, the second ground terminal has a first base slice, a first connecting slice slantwise extended upward and rearward, then extended rearward, next bent perpendicular to the first base slice, and further slantwise extended downward from a rear end of the first base slice, a first soldering slice extended transversely, and then bent forward from a free end of the first connecting slice to be soldered to a top surface of a rear end of the first base strip, the third signal terminal has a second fastening slice, and a second soldering slice slantwise extended rearward and towards the fourth signal terminal, and then extended transversely and away from the second fastening slice from one side of a rear end of the second fastening slice to be soldered to a top surface of the front end of the second base strip, the fourth signal terminal has a rectangular third fastening slice, a second connecting slice extended transversely and away from the second power terminal, and then slantwise extended downward from a front end of the third fastening slice, and a third soldering slice extended transversely and away from the third fastening slice from a free end of the second connecting slice to be soldered to the top surface of a front end of the third fastening strip, the second power terminal has an elongated second base slice disposed to an inner side of the first soldering slice, a third connecting slice slantwise extended upward and away from the first soldering slice, then extended transversely and towards the second ground terminal, and further slantwise extended downward and away from the second base slice from one side of a rear end of the second base slice adjacent to the fourth signal terminal, and a fourth soldering slice extended transversely and towards the second ground terminal, and then extended forward from a free end of the third connecting slice to be soldered to a top surface of a rear end of the fourth base strip.

6. The universal serial bus connector as claimed in claim 5, wherein the second ground terminal has a first fastening slice slantwise extended upward and forward, then extended forward and towards the third signal terminal and further extended forward from a front end of the first base slice, the second power terminal has a fourth fastening slice slantwise extended upward and forward, then extended forward and away from the fourth signal terminal and further extended forward from a front end of the second base slice, the front end of the first base slice with the first fastening slice, the second fastening slice with the second soldering slice, the third fastening slice with the second connecting slice and the third soldering slice, the front end of the second base slice with the fourth fastening slice are transversely and integrally molded in the tongue board assembly.

7. The universal serial bus connector as claimed in claim 6, wherein the first fastening slice is located over the fourth fastening strip, the second fastening slice is located over the third fastening strip, the third fastening slice is located over the second fastening strip, and the fourth fastening slice is located over the first fastening strip.

8. The universal serial bus connector as claimed in claim 6, wherein top surfaces of middles of the first base slice, the second base slice, the first base strip, the second base strip, the third base strip and the fourth base strip are aligned, and the middles of the first base slice, the second base slice, the first base strip, the second base strip, the third base strip and the fourth base strip are received in the guiding groove.

9. The universal serial bus connector as claimed in claim 6, wherein the second ground terminal has a first touching portion punched upward from a bottom surface of the first base slice and projecting beyond a top surface of the first fastening slice, the third signal terminal has a second touching portion punched upward from a bottom surface of the second fastening slice and projecting beyond a top surface of the second fastening slice, the fourth signal terminal has a third fastening slice, fourth signal terminal has a third touching portion punched upward from a bottom surface of the third fastening slice and projecting beyond a top surface of the third fastening slice, the second power terminal has a fourth touching portion punched upward from a bottom surface of the fourth fastening slice and projecting beyond a top surface of the fourth fastening slice, the first touching portion, the second touching portion, the third touching portion and the fourth touching portion project beyond the top of the tongue board assembly.

10. The universal serial bus connector as claimed in claim 9, wherein the first touching portion is symmetrical to the fourth contact portion with respect to the tongue board assembly, the second touching portion is symmetrical to the third contact portion with respect to the tongue board assembly, the third touching portion is symmetrical to the second contact portion with respect to the tongue board assembly, and the fourth touching portion is symmetrical to the first contact portion with respect to the tongue board assembly.

11. The universal serial bus connector as claimed in claim 9, wherein the tongue board assembly includes a first tongue board and a second tongue board, the second tongue board is integrally molded to an outside of the first tongue board, front ends of the first conductive terminals and outer peripheries of the front ends of the second conductive terminals.

12. The universal serial bus connector as claimed in claim 11, wherein the first tongue board defines a plurality of the first openings, the first fastening strip, the second fastening strip, the third fastening strip and the fourth fastening strip are integrally molded to the first tongue board in sequence with the first contact portion, the second contact portion, the third contact portion and the fourth contact portion projecting under a bottom surface of the first tongue board, through the first openings, the front end of the first base strip with the first fastening strip, the front end of the second base strip with the second fastening strip, the front end of the third base strip with the third fastening strip, and the front end of the fourth base strip with the fourth fastening strip are transversely and integrally molded in the second tongue board in sequence.

13. The universal serial bus connector as claimed in claim 12, wherein the second tongue board defines a plurality of the second openings corresponding to the first openings, the first fastening slice, the second fastening slice, the third fastening slice and the fourth fastening slice are transversely disposed on a top surface of the first tongue board in sequence, the first touching portion, the second touching portion, the third touching portion and the fourth touching portion are transversely located above the top surface of the first tongue board in sequence, the front end of the first base slice with the first fastening slice, the second fastening slice with the second soldering slice, the third fastening slice with the second connecting slice and the third soldering slice, the front end of the second base slice with the fourth fastening slice are transversely and integrally molded in the second tongue board, the first contact portion, the second contact portion, the third contact portion and the fourth contact portion project under a bottom surface of the second tongue board, the first touching portion, the second touching portion, the third touching portion and the fourth touching portion project beyond a top surface of the second tongue board through the second openings.

14. The universal serial bus connector as claimed in claim 13, wherein the first touching portion is symmetrical to the fourth contact portion with respect to the first tongue board, the second touching portion is symmetrical to the third contact portion with respect to the first tongue board, the third touching portion is symmetrical to the second contact portion with respect to the first tongue board, the fourth touching portion is symmetrical to the first contact portion with respect to the first tongue board.

15. The universal serial bus connector as claimed in claim 11, wherein a front of the second tongue board protrudes outward to form a mushroom-head guiding portion projecting beyond a top surface and a bottom surface of the second tongue board, when the universal serial bus connector is inserted into a docking connector, the tongue board assembly is guided by the guiding portion to be inserted forward.

16. The universal serial bus connector as claimed in claim 11, wherein the insulating housing includes a first base body, and two second base bodies respectively disposed to a top and a bottom of the first base body, a front end of the first base body defines a U-shaped first locating groove penetrating through a top surface, two tops of two opposite side surfaces and two tops of two opposite sides of a front surface thereof, and a U-shaped second locating groove penetrating through a bottom surface, two bottoms of the two opposite side surfaces and two bottoms of the two opposite sides of the front surface thereof, each second base body has a base portion, and a U-shaped locating portion connected with a rear surface of the base portion, the locating portion includes two extending portions extended rearward from two opposite sides of the rear surface of the base portion, and a connecting portion connected between two distal ends of the two extending portions, a rear of the inner surface of the base portion is recessed inward to form a second lacking groove penetrating through a rear surface of the connecting portion, the second base bodies are oppositely disposed to a top and a bottom of the first base body, the locating portions are respectively located in the first locating groove and the second locating groove, an upper portion and a lower portion of the front surface of the front end of the first base body respectively abut against front sidewalls of the second lacking groove.

17. The universal serial bus connector as claimed in claim 16, wherein a front of an inner surface of the base portion is inclined forward and inward to form a guiding surface, the two guiding surfaces are disposed oppositely, front ends of the base portions are spaced from each other and project beyond the front surface of the front end of the first base body to form the guiding groove thereamong.

18. The universal serial bus connector as claimed in claim 16, wherein the first ground terminal has a first soldering strip extended towards the first signal terminal and then extended rearward from a rear end of the first base strip, the first signal terminal has a second soldering strip extended rearward from a rear end of the second base strip, the second signal terminal has a third soldering strip extended rearward from a rear end of the third base strip, the first power terminal has a fourth soldering strip extended rearward from a rear end of the fourth base strip, the rear end of the first base strip with the first soldering strip, the rear end of the second base strip with the second soldering strip, the rear end of the third base strip with the third soldering strip, the rear end of the fourth base strip with the fourth soldering strip, the rear end of the first base slice, the first connecting slice, the first soldering slice, the rear end of the second base slice, the third connecting slice and the fourth soldering slice are integrally molded to the first base body, the first soldering strip, the second soldering strip, the third soldering strip and the fourth soldering strip are exposed in the first lacking groove, bottom surfaces of the first soldering strip, the second soldering strip, the third soldering strip and the fourth soldering strip are aligned and are flush with the top sidewall of the first lacking groove.

19. The universal serial bus connector as claimed in claim 16, wherein the shielding shell includes a first shell, and a hollow-shaped second shell, the first shell surrounds the first base body, a rear end of the second shell surrounds and is soldered with a front end of the first shell, a front end of the second shell surrounds the front ends of the base portions of the second base bodies and the tongue board assembly together with the front ends of the first conductive terminals and the second conductive terminals to form the insertion space among the front end of the second shell, the front ends of the base portions of the second base bodies and the tongue board assembly.

20. The universal serial bus connector as claimed in claim 19, wherein the first shell has a top plate, two lateral plates extended downward from two opposite sides of the top plate, and a bottom plate connected between two fronts of two bottom edges of the two lateral plates, front edges of the top plate and the bottom plate are spread outward, and then extend forward to form two first buckling plates, two front edges of the two lateral plates are arched outward and then extend forward to form two second buckling plates, the base portion defines a first buckling groove penetrating through a rear of an outer surface and a rear surface thereof, the base portion defines two second buckling grooves respectively penetrating through two opposite side surfaces, two opposite sides of the inner surface, and two opposite sides of the rear surface thereof, the first buckling plate is buckled in the first buckling groove, the second buckling plate is buckled in the second buckling groove and resists against a front sidewall of the second buckling groove, the rear end of the second shell surrounds outsides of the first buckling plates and the second buckling plates, insides of a top and a bottom of the rear end of the second shell are soldered to the outsides of the first buckling plates.

* * * * *